United States Patent [19]

Scarnera

[11] Patent Number: 4,847,771

[45] Date of Patent: Jul. 11, 1989

[54] SYSTEM FOR AUTOMATIC CONTROL OF THE FUEL MIXTURE STRENGTH SUPPLIED IN SLOW RUNNING CONDITIONS TO A HEAT ENGINE HAVING AN ELECTRONIC FUEL INJECTION SYSTEM

[75] Inventor: Michele Scarnera, Monzuno, Italy

[73] Assignee: Weber S.p.A., Turin, Italy

[21] Appl. No.: 907,309

[22] Filed: Sep. 12, 1986

[30] Foreign Application Priority Data

Sep. 20, 1985 [IT] Italy ..... 67801 A/85

[51] Int. Cl.[4] ..... F02D 5/00

[52] U.S. Cl. ..... 364/431.05; 364/158; 123/585; 123/419; 123/339

[58] Field of Search ..... 123/525, 588, 340, 586, 123/585, 436, 419, 339; 364/431.05, 431.07

[56] References Cited

U.S. PATENT DOCUMENTS

| | | | |
|---|---|---|---|
| 3,863,054 | 1/1975 | Monpetit | 364/431.05 |
| 3,960,320 | 6/1976 | Slater | 364/158 |
| 4,344,399 | 8/1982 | Matsumura et al. | 123/339 |
| 4,378,767 | 4/1983 | Kobashi et al. | 123/339 |
| 4,387,682 | 6/1983 | Miyagi et al. | 123/339 |
| 4,401,073 | 8/1983 | Furuhashi | 123/339 |
| 4,428,342 | 1/1984 | Suzuki et al. | 364/158 |
| 4,478,185 | 10/1984 | Obayashi et al. | 364/431.05 |
| 4,478,191 | 10/1984 | Kinoshita et al. | 123/589 |
| 4,491,108 | 1/1985 | Hasegawa et al. | 123/585 |
| 4,564,419 | 1/1986 | Ninomiya et al. | 123/489 |
| 4,586,473 | 5/1986 | Nguyen | 123/419 |
| 4,640,244 | 2/1987 | Koike et al. | 123/339 |
| 4,667,632 | 5/1987 | Shimomura et al. | 123/340 |
| 4,681,075 | 7/1987 | Yamato et al. | 123/339 |
| 4,688,535 | 8/1987 | Kuttner et al. | 123/419 |
| 4,690,121 | 9/1987 | Kuwanabe et al. | 123/587 |
| 4,703,430 | 10/1987 | Amano et al. | 364/431.05 |
| 4,708,108 | 11/1987 | Sakamoto et al. | 123/339 |
| 4,708,109 | 11/1987 | Takao | 123/339 |

FOREIGN PATENT DOCUMENTS

| | | | |
|---|---|---|---|
| 2038041 | 6/1980 | United Kingdom | 123/339 |

*Primary Examiner*—Parshotam S. Lall
*Assistant Examiner*—Ellis B. Ramirez
*Attorney, Agent, or Firm*—Gifford, Groh, Sheridan, Sprinkle and Dolgorukov

[57] ABSTRACT

A system for automatic control of the fuel mixture strength supplied in slow-running conditions to a heat engine having a fuel injection system and means for supplying supplementary air in adjustable quantities, comprising first means for periodically varying the quantity of supplementary air supplied to the engine and for detecting the consequent variation in the slow running of the engine for the purpose of obtaining activation for second means for modification of the quantity of fuel supplied to the injectors of the system for compensating the variation in the strength of the mixture.

12 Claims, 2 Drawing Sheets

SYSTEM FOR AUTOMATIC CONTROL OF THE FUEL MIXTURE STRENGTH SUPPLIED IN SLOW RUNNING CONDITIONS TO A HEAT ENGINE HAVING AN ELECTRONIC FUEL INJECTION SYSTEM

BACKGROUND OF THE INVENTION

The present invention relates to an automatic system for control of the mixture strength supplied in slow-running conditions to a heat engine having an electronic fuel injection system, in particular a sequential and phased system, and including a valve for supply of supplementary air in adjustable quantities, generally disposed to divide a duct connecting zones upstream and downstream of the butterfly valve controlled by the accelerator.

As is known, drift of the petrol/air mixture strength with which a heat engine is supplied is a rather typical phenomenon so much so that periodic adjustment has to be made to the supply system both in new systems and during its lifetime, following ageing of the engine and drift of its components. Such drift of the mixture strength is particularly unwanted in the case of electronic injection systems which due to their better operation necessitate very precise general control strategies of operation of the engine, in that there exists an electronic central control unit which, in dependence on signals which is receives from various sensors (principally sensors detecting the speed of rotation and phases of the engine, and sensors detecting the pressure and temperature of the inducted air) determines for example the density of the air in the manifold and the speed of rotation of the engine, from which, in dependence on the desired mixture strength it calculates through an interpolation on respective memorized mappings a phase and duration of injection of the fuel at the injectors as well as the ignition advance. Currently the operator effects periodic adjustment of the mixture strength by detecting the concentration of exhaust gas at slow running, by acting on a trimmer which corrects the duration of the injection time.

SUMMARY OF THE INVENTION

The object of the present invention is that of providing an automatic control system for controlling the fuel mixture strength in slow running conditions, so as to maintain it in the desired tolerance range and overcome the above indicated disadvantages of drift and the necessity for periodic adjustments.

According to the present invention there is provided an automatic system for control of the fuel mixture strength supplied in slow running conditions to a heat engine having an electronic injection system and means for supplying supplementary air in adjustable quantities, characterised by the fact that it includes first means for periodically varying said quantity of supplementary air supplied and for detecting the consequent variation in slow running of said engine for the purpose of obtaining activation for second means for modifying the quantity of fuel supplied to the injectors of said system to compensate the variation in said mixture strength.

BRIEF DESCRIPTION OF THE DRAWINGS

For a better understanding of the present invention a particular embodiment is now described, purely by way of non-limitative example, with reference to the attached drawings, in which.

DETAILED DESCRIPTION OF THE INVENTION

Figure 1:
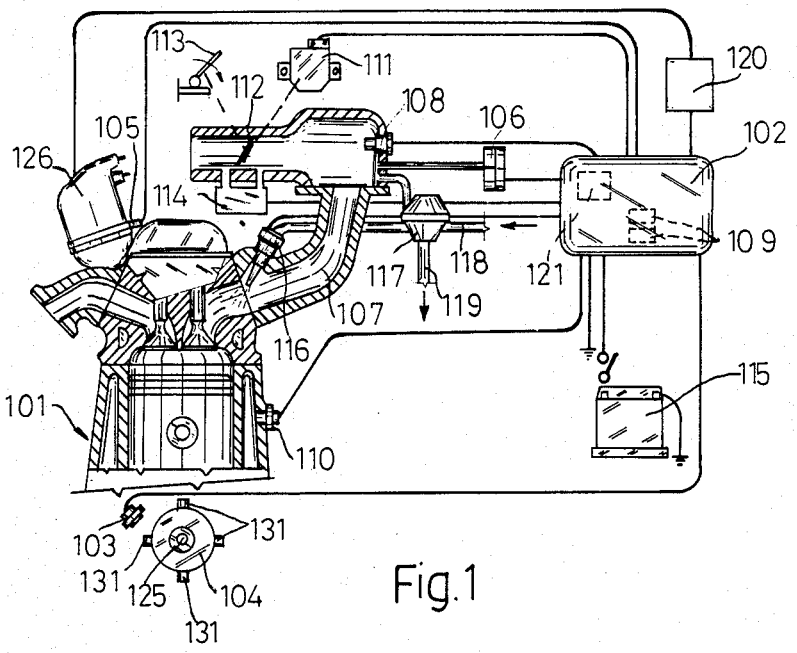
FIG. 1 is a schematic view of an electronic injection system for a heat engine with an automatic system for controlling the fuel mixture strength under slow running conditions, formed according to the present invention.

With reference to FIG. 1, there is schematically shown an electronic injection system for a heat engine 101, conveniently a four-cylinder engine which is only partially shown in section. This system includes an electronic central control unit 102 including, in a substantially known way, a microprocessor 121 and registers in which there are memorized mappings relating to different operating conditions of the engine 101, as well as various counters and random access memory registers (RAM).

This central control unti 102 receives signals from:

- a sensor 103 for detecting the speed of rotation of the engine 101, disposed opposite a pulley 104 having four equally spaced teeth 131 keyed onto a crankshaft 125,
- a sensor 105 for detecting the phase of the engine 101, positioned in a distributor 126,
- a sensor 106 for detecting the absolute pressure existing in an induction manifold 107 of the engine 101,
- a sensor 108 for detecting the temperature of the air in the manifold 107,
- a sensor 110 for detecting the temperature of the water in the cooling jacket of the engine 101,
- a sensor 111 constituted substantially by a potentiometer and a detector for detecting the angular position of a butterfly valve 112 disposed in the induction manifold 107 and controlled by an accelerator pedal 113: between the zones of the induction manifold 107 upstream and downstream of the butterfly valve 112 is connected a supplementary air supply valve 114 the closure position of which is controlled by the central control unit 102; in particular this valve 114 can be an electromagnetically controlled valve of the type described in Patent Application No. 3386-A/83 filed Apr. 12, 1983 by the same applicant.

This electronic central control unit 102 is connected to an electrical supply battery 115 and to earch, and, in dependence on the signals from said sensors, the speed of rotation of the engine and the density of the air are utilized to determine the quantity of fuel in dependence on the desired mixture strength. This central control unit 102 therefore controls the duration of opening of the electro-injectors 116 disposed in the manifold 107 close to the induction valve of each respective cylinder, to meter the quantity of fuel provided to the different cylinders of the engine 101 and to control the phasing of the injection to determine the commencement of fuel delivery with respect to the phases (induction, compression, expansion, exhaust) of the engine 101. Each electro-injector 116 is supplied with fuel through a pressure regulator 117 sensitive to the pressure in the induction manifold 107 and having a fuel inlet duct 118 for fuel coming from a pump (not illustrated), and a return duct 119 leading to a reservoir (not illustrated). This electronic central control unit 102 is moreover connected to a unit 120 for control of the ignition pulses which are provided to the various cylinders through the distributor 126, and controls the valve 114 for controlling the supply of supplementary air in a manner which will be described in more detail hereinbelow, according to the characteristics of the present invention, the principle of operation of which is summarized with reference to FIG. 2 which is a graph on which are plotted, along the abscissa, the values of the mixture strength, that is to say the ratio of the quantity of fuel injected to the quantity of air supplied, whilst along the ordinate are plotted the values of engine torque which are proportional to the speed of rotation of the engine. In this graph there is illustrated a curve for constant quantity of fuel ($Q_B$) which has maximum, indicated A, which corresponds to the point of maximum economy, which is the condition in which all the fuel injected is burnt. If the mixture strength is varied by varying only the quantity of air supplied, this curve is displaced, and for higher ratios B:A, that is to say richer mixtures, one arrives for example at point P″ in which the engine torque and the speed of rotation fall because part of the fuel is not burnt, whilst for lower ratios B:A, that is to say leaner mixtures, to the left of the point A, again a diminution of the engine torque and of the speed of rotation is experienced in that the excess air reduces the speed of the combustion reaction, which deteriorates. At the calibration point of the mapping of the central control unit 102 there is chosen a slightly richer mixture strength than that of point A, that is to say corresponding to point P to compensate the poor distributions and irregularities deriving from the low air density in slow running conditions which are the most critical.

Figure 2:
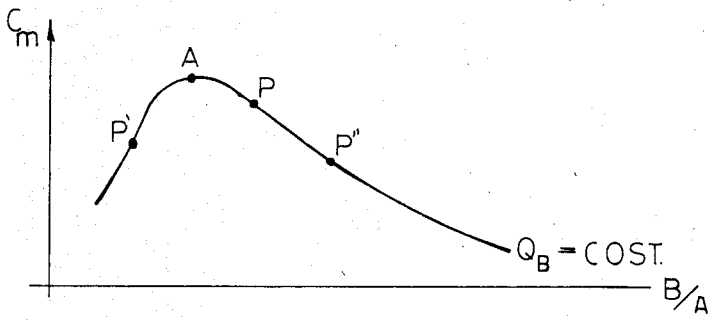
FIG. 2 illustrates in schematic form a graph of the operation of the heat engine of FIG. 1.

According to the principle of the present invention as can be seen from the graph of FIG. 2, a given modulation of the air flow rate will produce different effects on the engine torque, and therefore on the speed of rotation according as it is applied at different points along this curve: the resultant variation in the speed of rotation is proportional to the derivative at the point of application and the phase (that is to say the concordance of sign between the variations of the ratio B:A and the engine torque variations) will be positive for points to the left of point A and negative for points to the right of point A. In this way, with a modulation of the flow rate of supplementary air one can detect the variations in the speed of rotation of the engine and therefore recognize if the displacement of the mixture strength is towards the zone to the left or the zone to the right of the point A, and therefore consequently correct the drift in the mixture strength to maintain it in the desired range of variations.

Figure 3:
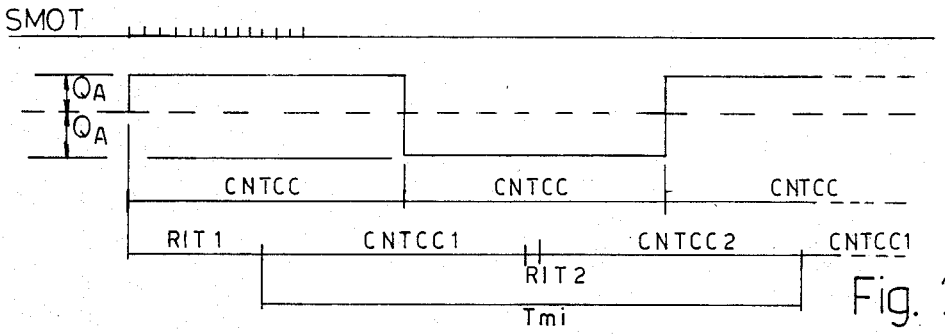
FIG. 3 illustrates various signals present in the control system of the present invention.
Figure 4:
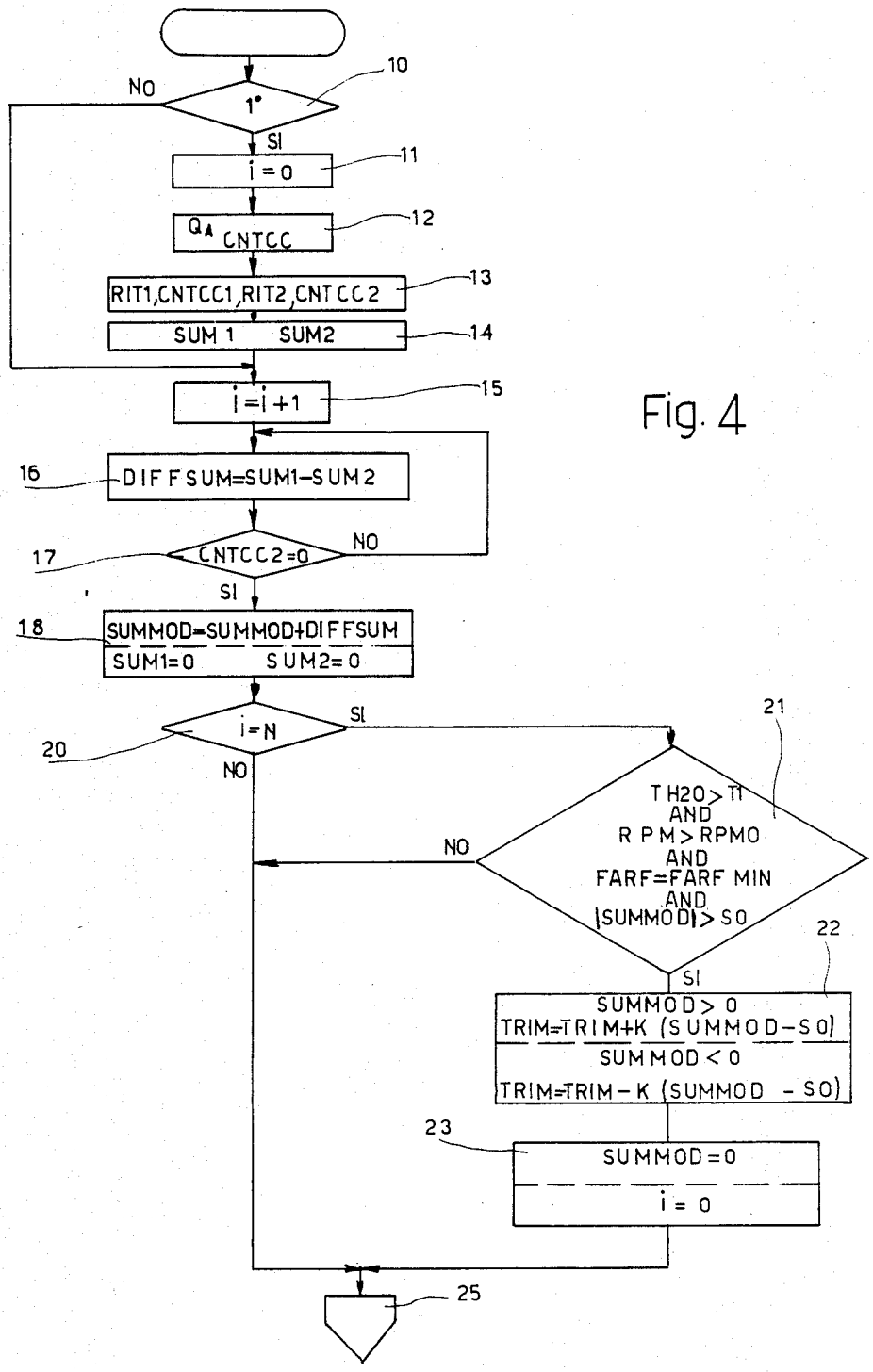
FIG. 4 is a flow chart illustrating the operation of the automatic control system of the present invention.

With reference to FIG. 4, the program of the electronic injection system controlled by the microprocessor 121 starts each cycle at a stage 10 at which it is detected whether this is the first time this part of the program for automatic control of the fuel mixture strengt in slow running conditions is being performed: in the positive case the program passed to stage 11 at which the index i is set to 0 (i=0), and the program then passes to a stage 12 at which the periodic supply of the quantity of supplementary air $Q_A$ is controlled about a mid value via the electromagnetic valve 114, and inverted at each period CNTCC determined by a counter of the central control unit 102 which is started at a predetermined value and decremented by signals SMOT coming, as can be seen in FIG. 3, from the sensor 103 at each 90° of rotation of the engine crankshaft 125 (FIG. 1); upon zeroing of this counter CNTCC the control signal to the valve 114 is modified so as to invert the sign of the variation of quantity of additional air with respect to the mean-value, and the initial value of the counter is renewed for the decremental count which determines the new period CNTCC, which, in conditions of slow running of the engine 101, lasts about 1.25 seconds. The duration of this period CNTCC, and the variation $Q_A$ of the additional air, equal to about 4% of the air supplied through the butterfly valve 112 in the slow running conditions, is such as to cause variations in the drive torque which are distinguishable from perturbations which can arise in the engine due to poor stability of the speed of rotation due to other causes.

From the stage 12 the program leads to a stage 13 which determines via one or more counters the count of respective successive periods, illustrated in FIG. 3 and indicated with RIT1, CNTCC1, RIT2, CNTCC2, CNTCC1,...Such periods are determined by the decremental count down to zero of a respective counter starting from a predetermined value, and for which there are provided as clock signals the same signal SMOT from the sensor 103 also provided to the counter for determining the period CNTCC as already described. The periods CNTCC1 and CNTCC2 have the function of determining the detection window through which the perturbations of the speed of rotation caused by the introduction of supplementary air $Q_A$ with the respective increase and decrease with respect to the mean value are determined, whilst the period RIT1 has the function of determining an adequate detection delay with respect to the commencement of the modification of the additional air to take account of the intrinsic delay of the supply and distribution system of the engine, whilst the period RIT2 has the function of taking account of this intrinsic delay in the variations in the sign of the additional air $Q_A$ with respect to the mean values.

In particular, the period RIT1 is equal to about half the duration of the period CNTCC, the period RIT2 is of substantially negligible duration, whilst the periods CNTCC1 and CNTCC2 are of substantially the same duration, equal to that of the period CNTCC of application, with constant sign, of the quantity Q of the additional air. With the commencement of periodic variation of the quantity of additional air $Q_A$ the count period RIT1 ceases and is succeeded by counts of periods CNTCC2 and CNTCC1, and so on, with the eventual introduction of the period RIT2. With reference again to FIG. 4, part of the stage 13 is a stage 14 which calculates the memories indicated respectively SUM1 and SUM2 the sum of the time intervals between the various signals SMOT in the respective acquisition windows CNTCC1 and CNTCC2 corresponding to the mean speed of rotation in these windows. After the stage 14 there is a stage 15 which increments by one unit the value of the index i, putting: $i=i+1$, and the program arrives directly at this stage 15 in the case of the negative condition detected at stage 10, that is to say in the case of subsequent repetitions of the program. After the stage 15 is a stage 16 at which is calculated, in a register DIFFSUM, the difference between the values in the registers SUM1 and SUM2, that is to say the difference between the mean speeds of rotation in the windows CNTCC1 and CNTCC2 are detected; it must also be noted that since these windows can have different basic durations determined by a different count of signals SMOT, the value calculated in the register SUM1 and SUM2 at stage 14 can be altered to normalize it and make it refer to the same signal count SMOT in the two windows.

After the stage 16 there is a stage 17 which detects if the count window of period CNTCC2 is concluded, that is to say if the associated counter has reached zero: in the negative case it returns to stage 16, whilst in the positive case it passes to a stage 18 which puts the value SUMMOD into an associated register equal to the previously memorized value (SUMMOD) to which is added the value DIFFSUM determined at stage 16; at stage 18 the registers SUM1 and SUM2 are then returned to zero. The program then leads to a stage 20 which determines if the index i is equal to N (for example 20) to detect if this modulation cycle of additional air and measurement of the variation of the speed of rotation of the engine 101 indicated $T_{mi}$ (FIG. 3) has been repeated for a sufficient number of times, established by N. In the positive case it leads to a stage 21 which detects if the temperature of the engine cooling water detected by the sensor 110 is greater than a predetermined value ($T_1$), if the speed of rotation of the engine is greater than a predetermined threshold value (RPMO), if the butterfly valve 112 (FARF) is in the minimum position (FARFMIN) and if the value (SUMMOD) of the difference in the speed of rotation between the positive and negative increments of the additional air via the valve 114, repeated for the predetermined number of cycles N is, in absolute value, greater than a threshold value $S_o$, which is indicative of a displacement of the speed of rotation of the engine, and therefore of the mixture strength, at slow running of the engine, greater than the admissible range of variation. In the positive case the program passes to stage 22 which evaluates if the value of the parameter SUMMOD is positive or negative; in the first case this is indicative of a displacement from the point P (FIG. 2) towards the point P″that is to say in the section of the curve to the right of the point A, so that it is necessary to reduce the quantity of fuel injected to bring the point P″ back towards the point P, and therefore the additional regulation time for disablement of the injector 116 is calculated in an incremented manner, that is to say equal to:

$$\text{TRIM}=\text{TRIM}+K\,(\text{SUMMOD}-S_o)$$

On the other hand if the value SUMMOD is negative, this indicates that the point P is in the zone to the left of the point A (point P′), that is to say the mixture strength is displaced towards leaner mixture conditions so that it is necessary to reduce the disablement time of the injector, and the correction parameter TRIM is put equal to:

$$\text{TRIM}=\text{TRIM}-K\,(\text{SUMMOD}-S_o)$$

From the stage 22 the program then passes to a stage 23 which puts the value SUMMOD in the respective registers equal to zero, and likewise zeros the index i to enable successive cycles of calculation of this automatic control system of the slow running mixture strength. After the stage 23 there is then a stage 25 which controls the subsequent operation of the program through the microcomputer 121 for actuation of sequential and phased controls supplied to the electro injectors 116. The program passes directly to this stage 25 in the case of negative conditions established at stage 20, that is to say if the repetitive cycles of modulation of the additional air and measurement of the variation of the speed of rotation of the engine have not been performed for the total desired number N of cycles, or in the case of negative conditions established by the stage 21, that is to say, if the temperature of the cooling water of the engine is relatively low, if the speed of rotation is low, if the butterfly valve 112 is not in its minimum position, or if the variation of the speed of rotation (SUMMOD) does not exceed the predetermined threshold value $S_o$, that is to say, if the variation of the mixture strength has not passed out of the desired range, which implies that the operating point is around the initially established point P of FIG. 2.

The advantages obtained with the automatic slow running mixture strength control system formed according to the present invention are apparent from what has been described above in that the periodic calibration operations by the operater are now eliminated with a guarantee that the engine will always function within the desired range of parameters.

Finally, it is clear that the embodiment of the automatic control system of the present invention described can be modified and varied without departing from the scope of the invention itself.

I claim:

1. An automatic control system for adjusting the strength of the fuel mixture supplied, in slow running conditions, to a heat engine (101) having an electronic fuel injection system and means (114) for the supply of supplementary air in adjustable quantities, comprising first means (12,13,14,16,18) for periodically varying said quantity of supplementary air supplied to the engine and for detecting the consequent variation in the slow running speed of said engine, and second means (22) for modifying the quantity of fuel supplied to the injectors (116) of said system to compensate for variations in said mixture strength, activated by said first means.

2. A system according to claim 1, wherein said first means (12,13,14,16,17,18,20,21) and said second means (22) are incorporated in a microprocessor (121) forming part of an electronic central control unit (102) for control of said injection system.

3. A system according to claim 1, wherein said first means includes means (12) for causing, by varying said supplementary air supply means (114), a periodic increase and decrease in quantity of the said air about a mean value, and means (13,14,16,18) for calculating the corresponding variation in the speed of rotation of the engine (101) as a direct consequence of said increase and decrease in the supplementary air, and for detecting if said increase or decrease of air corresponds to an increase or decrease of said speed of rotation or vice versa.

4. A system according to claim 3, wherein said means (12) for controlling said periodic variations of said quantity of supplementary air includes a counter having a predetermined count and a clock signal which is provided by a signal (SMOT) the frequency of which is a function of the speed of rotation of the engine, and said means for the supply of supplementary air comprises an electromagnetically controlled valve (114) disposed in parallel with a butterfly valve (112) controlled by an accelerator (113).

5. A system according to claim 4 wherein in slow running conditions the duration of said periodic variations is about 1.25 seconds, and said modulated quantity of supplementary air is about 4% of the main quantity of air in slow running conditions.

6. A system according to claim 3, wherein said means for calculating the corresponding variation of the speed of rotation of the engine includes counter means (13,14) having a predetermined count and a clock signal which is provided by a signal (SMOT) the frequency of which is a function of the speed of rotation of the engine, said calculating means determining corresponding count windows (CNTCC1, CNTCC2) during which the speed of rotation of the engine is detected, and further including means (16) for calculating the difference between the mean speeds during said count windows.

7. A system according to claim 6, wherein the said count windows (CNTCC1, CNTCC2) have a duration of the same order as that (CNTCC) of said periodic variations in the supplementary air.

8. A system according to claim 6 wherein before the first count window (CNTCC1) there is disposed a delay window (RIT1) of a duration of about half that of the periodic variations (CNTCC) of said supplementary air, and wherein between said two count windows can be disposed a supplementary delay window (RIT2) of relatively short duration.

9. A system according to claim 6 wherein said first means for enabling activation of the said second means (22) includes means (21) for verifying that the cooling water temperature of said engine exceeds a predetermined value, that the speed of rotation of the engine is greater than a predetermined value, that the butterfly valve (112) for regulation of the main air supply is in a minimum position, and that said means speed difference over a relatively long interval is greater than a predetermined value.

10. A system according to claim 6, wherein said second means (22) includes means for reduction or increase of the quantity of fuel supplied to said injectors (116) if said means speed difference over a relatively long interval is positive or negative, respectively.

11. A system according to claim 6, wherein said first means (12,13,16,18) effects repeated operations to obtain said mean speed difference over a relatively long interval.

12. A system according to claim 11, wherein said relatively long interval is about 50 seconds.

* * * * *